US011992058B2

(12) United States Patent
Taurino

(10) Patent No.: US 11,992,058 B2
(45) Date of Patent: May 28, 2024

(54) LIQUID SUPPLY SYSTEM FOR USE IN AEROSOL-GENERATING DEVICES

(71) Applicant: PHILIP MORRIS PRODUCTS S.A., Neuchatel (CH)

(72) Inventor: Irene Taurino, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 658 days.

(21) Appl. No.: 17/278,825

(22) PCT Filed: Oct. 1, 2019

(86) PCT No.: PCT/EP2019/076555
§ 371 (c)(1),
(2) Date: Mar. 23, 2021

(87) PCT Pub. No.: WO2020/070110
PCT Pub. Date: Apr. 9, 2020

(65) Prior Publication Data

US 2022/0030950 A1 Feb. 3, 2022

(30) Foreign Application Priority Data

Oct. 3, 2018 (EP) ..... 18198504

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01)

(58) Field of Classification Search
CPC ..... A61M 11/042; A24F 40/10; A24F 40/485; A24F 40/44; A24F 40/42
See application file for complete search history.

(56) References Cited

U.S. PATENT DOCUMENTS 10,602,777 B2 3/2020 Dickens
11,096,423 B2 8/2021 Macko
(Continued)

FOREIGN PATENT DOCUMENTS

CN 207370095 5/2018
EP 3634163 4/2021
(Continued)

OTHER PUBLICATIONS

Search Report and Written Opinion for PCT/EP2019/076555 dated Oct. 1, 2019 (12 pages).
(Continued)

*Primary Examiner* — Marcus E Harcum
(74) *Attorney, Agent, or Firm* — Mueting Raasch Group

(57) ABSTRACT

A liquid supply system for use with an aerosol-generating device, the liquid supply system comprising a liquid retention material (136), a liquid flow channel extending from the liquid retention material and a barrier (125) disposed in the liquid flow channel, the barrier having a threshold temperature between 60° C. and 120° C., wherein the barrier is impermeable to liquid below its threshold temperature and the barrier becomes reversibly permeable to liquid above the threshold temperature.

14 Claims, 4 Drawing Sheets

(51) Int. Cl.
*A24F 40/42* (2020.01)
*A24F 40/44* (2020.01)

(56) References Cited

U.S. PATENT DOCUMENTS

| | | | | |
|---|---|---|---|---|
| 2015/0313285 | A1 | 11/2015 | Waller | |
| 2016/0345630 | A1* | 12/2016 | Mironov | A61M 11/042 |
| 2017/0049154 | A1* | 2/2017 | Batista | H05B 1/0244 |
| 2017/0071253 | A1* | 3/2017 | Revell | H05B 3/44 |
| 2017/0231276 | A1* | 8/2017 | Mironov | H05B 1/0244 131/328 |
| 2017/0318862 | A1 | 11/2017 | Mironov | |
| 2018/0242642 | A1* | 8/2018 | Silvesstrini | H05B 1/0227 |
| 2018/0242643 | A1* | 8/2018 | Silvesstrini | H05B 3/34 |
| 2018/0242644 | A1* | 8/2018 | Bessant | H05B 3/34 |

FOREIGN PATENT DOCUMENTS

| | | |
|---|---|---|
| JP | 2016-500272 | 1/2016 |
| JP | 2020-522236 | 7/2020 |
| JP | 2020-534870 | 12/2020 |
| RU | 2651538 | 4/2018 |
| WO | WO 2015/070405 | 5/2015 |
| WO | WO 2016/118005 | 7/2016 |

OTHER PUBLICATIONS

Office Action issued in Japan for Application No. 2021-513209 dated Jan. 5, 2023 (6 pages). English translation included.
Office Action issued in Japan for Application No. 2021-513209 dated Apr. 13, 2022 (10 pages). English translation included.
Office Action issued in Russia for Application No. 2021108425/03 dated Sep. 17, 2021 (5 pages). English translation included.

* cited by examiner

LIQUID SUPPLY SYSTEM FOR USE IN AEROSOL-GENERATING DEVICES

This application is a U.S. National Stage Application of International Application No. PCT/EP2019/076555 filed Oct. 1, 2019, which was published in English on Apr. 9, 2020 as International Publication No. WO 2020/070110 A1. International Application No. PCT/EP2019/076555 claims priority to European Application No. 18198504.4 filed Oct. 3, 2018

This invention relates to electrically heated aerosol-generating systems and associated devices, articles, and methods. In particular, the invention relates to systems and methods for storing liquid aerosol-forming substrates for use in such aerosol-generating systems. This disclosure further relates to barrier materials used to prevent leakage of the liquid aerosol-forming substrate from such systems and from components of such systems.

One type of aerosol-generating system is an electrically operated elongate handheld aerosol-generating system, having a mouth end and a distal end. Known handheld electrically operated aerosol-generating systems may include a device portion comprising a battery and control electronics, a cartridge portion comprising a supply of aerosol-forming substrate, and an electrically operated vaporizer. A cartridge comprising both a supply of aerosol-forming substrate and a vaporizer is sometimes referred to as a "cartomizer." The vaporizer may include a coil of heater wire wound around an elongate wick soaked in liquid aerosol-forming substrate. However, some vaporizers include a heater mesh formed into a substantially planar shape and placed on top of a surface of a transport material (for example, a wick). Capillary material soaked in the aerosol-forming substrate supplies the liquid to the wick. When a user draws on the mouth end of the system, air is drawn into the vaporizer, the heater turns on and vaporizes a portion of the aerosol-forming substrate. A mouth piece opening at the mouth end of the system allows a user to inhale the generated aerosol.

Liquid aerosol-forming substrates for the aerosol-generating systems may be provided in a liquid supply system (for example, a cartridge) that includes a high retention material (HRM) for storing the liquid aerosol-forming substrate. When the system is used, the liquid substrate may be transferred from the high retention material to a transport material (TM), where the aerosol-forming substrate material may be heated and vaporized. However, during storage, it is desired that the liquid substrate does not prematurely transfer to the transport material and leak from the cartridge.

It would be desirable to inhibit premature leakage of the aerosol-forming substrate from the cartridge. It would further be desirable to conveniently permit transfer of the liquid aerosol-forming substrate to the heating element and into the airflow passage when the aerosol-generating system is in use.

In various aspects of the present invention there is provided an aerosol-generating system having a mouth end and a distal end. The system may include a liquid storage portion suitable for containing an aerosol-forming substrate. The system may further include a cover disposed over the liquid storage portion, and one or more airflow passages or channels between the cover and the liquid storage portion. The system may include a heating element constructed to heat the liquid aerosol-forming substrate.

The system may include an aerosol-generating device or base unit constructed to accept a cartridge that contains the aerosol-forming substrate in a high retention material. The system may also include a transport material constructed to deliver the aerosol-forming substrate to the heating element when the aerosol-generating system is in use.

The cartridge may include a barrier layer that prevents premature transfer of the liquid substrate into the airflow passage. The cartridge may include a liquid flow channel having an upstream end and a downstream end. The liquid flow channel may extend from the upstream end where the liquid is stored (for example, from the liquid storage portion or the high retention material) to the downstream end at the airflow passage. The barrier layer may be disposed in various locations along the liquid flow channel such that the barrier is located between the stored liquid substrate and the airflow passage. For example, the barrier layer may be disposed on the heating element (between the heating element and the airflow passage), between the transport material and the heating element, between the high retention material and the transport material, between the high retention material and the heating element, or between the liquid storage portion and the high retention material. The barrier may prevent transfer of the liquid substrate from the high retention material or from the liquid storage portion to the transport material, heating element, or airflow passage. The barrier layer is impermeable to liquids below a threshold temperature and becomes reversibly permeable to liquids at or above the threshold temperature, such as a temperature that may be achieved during use of the system, allowing liquids to transfer along the liquid flow channel. According to some aspects of the present invention, the barrier layer may be a thin impermeable film or a hydrophobic coating.

In one embodiment, the barrier layer is disposed downstream of the heater. In one embodiment, the barrier layer is disposed upstream of the heater, such as between the heater and the transport material, or between the heater and the high retention material. In one embodiment, the barrier layer is disposed upstream of the transport material, such as between the transport material and the high retention material. In one embodiment, the barrier layer is disposed upstream of the high retention material, such as between the high retention material and the liquid storage portion. In some embodiments, the cartridge includes more than one barrier layer, and the barrier layers may be disposed at any combination of the locations discussed above.

Systems of the present application may serve to reduce or prevent leakage of the liquid aerosol-forming substrate during storage. The systems are convenient to use as the barrier layer does not need to be manually removed or peeled off before use. For example, when the system is used, the system allows liquid transfer during normal use of the device.

The present invention provides, among other things, aerosol-generating systems and devices that use electrical energy to heat a substrate, without combusting the substrate, to form an aerosol that may be inhaled by a user. Preferably, the systems are sufficiently compact to be considered hand-held systems. Some examples of systems of the invention can deliver a nicotine-containing aerosol for inhalation by a user.

The term "aerosol-generating" article, device, or system refers to an article, device, or system capable of releasing volatile compounds from an aerosol-forming substrate to form an aerosol that may be inhaled by a user. The term "aerosol-forming substrate" refers to a substrate capable of releasing, upon heating, volatile compounds, which may form an aerosol. A liquid aerosol-forming substrate is a substrate that is liquid at ambient temperature, for example, at about 15° C. to about 30° C. Liquid aerosol-forming substrates are considered to include liquid solutions, suspensions, dispersions, and the like.

Any suitable aerosol-forming substrate may be used with the systems. Suitable aerosol-forming substrates may include plant-based material. For example, an aerosol-forming substrate may include tobacco or a tobacco-containing material containing volatile tobacco flavor compounds, which are released from the aerosol-forming substrate upon heating. In addition or alternatively, an aerosol-forming substrate may include a non-tobacco containing material. An aerosol-forming substrate may include homogenized plant-based material. An aerosol-forming substrate may include at least one aerosol former. Examples of aerosol formers include polyhydric alcohols, such as triethylene glycol, 1,3-butanediol, propylene glycol, and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. An aerosol-forming substrate may include other additives and ingredients such as flavorants. Preferably an aerosol-forming substrate includes nicotine. Preferably, the aerosol-forming substrate is a liquid aerosol-forming substrate. In some embodiments, an aerosol-forming substrate includes glycerol, propylene glycol, water, nicotine and, optionally, one or more flavorant.

According to aspects of the present disclosure, the aerosol-forming substrate may be stored in the liquid storage portion of the system and/or in a cartridge. The liquid storage portion may be part of a consumable part (for example, a cartridge), which the user can replace when the supply of the aerosol-forming substrate in the liquid storage portion is diminished or depleted. For example, the used liquid storage portion can be replaced with another liquid storage portion filled to an appropriate amount with aerosol-forming substrate. The cartridge may also be provided without the aerosol-forming substrate, and the user may fill the cartridge (for example, the liquid storage portion or the high retention material) with a desired substrate through a liquid port provided on the cartridge. In some embodiments, the liquid storage portion is not refillable by a user.

According to some aspects, the cartridge does not include a liquid storage compartment. Instead, the aerosol-forming substrate may be stored in the high retention material. In embodiments that do not include a liquid storage compartment, the amount of liquid aerosol-forming substrate and therefore also the number of puffs available from the device may be less than from devices that include a liquid storage compartment.

Aspects of the present disclosure relate to liquid storage units and systems. The liquid storage unit may be the liquid storage portion of a cartridge that includes both the liquid storage portion and a heating element. Alternatively, the liquid storage unit may be releasably connectable to a separate module having a heating element. Such liquid storage units may be referred to as "capsules." Although the liquid storage units described in this disclosure may be generally referred to as cartridges (liquid supply systems), aspects of the invention are equally applicable capsules (liquid storage units).

Preferably, the systems include a cartridge releasably connectable to a base unit. As used herein, "releasably connectable" means that the releasable connectable parts may be connected to, and disconnected from each other, without significantly damaging either part. A cartridge may be connected to a base unit in any suitable manner, such as threaded engagement, snap-fit engagement, interference-fit engagement, magnetic engagement, or the like.

If the system includes a separate vaporizing unit (for example, a separate unit containing the heating element) and capsule, the capsule may include a valve positioned relative to a distal end portion opening to prevent the aerosol-forming substrate from exiting the reservoir when the capsule is not connected to the vaporizing unit. The valve may be actuatable such that the act of connecting the capsule to the vaporizing unit causes the valve to open and disconnecting the capsule from the vaporizing unit causes the valve to close. Any suitable valve may be used.

The liquid supply system includes a housing, which may be a rigid housing. As used herein "rigid housing" means a housing that is self-supporting. The housing may be formed of any suitable material or combination of materials, such as a polymeric material, a metallic material, or a glass. Preferably, the housing of the liquid storage portion is formed by a thermoplastic material. Any suitable thermoplastic material may be used. In preferred examples, a passage is defined through the housing that forms at least a portion of the aerosol flow path.

The liquid storage unit includes aerosol-forming substrate in a high retention material, a transport material constructed to deliver the aerosol-forming substrate to the heating element, and a barrier layer or coating between the high retention material and the transport material. The barrier layer may have a reversible barrier quality. That is, the barrier layer may reversibly become permeable above a threshold temperature. A "high retention material" is a material that is capable of absorbing and/or storing liquid (for example, aqueous liquid) and is capable of conveying the liquid (for example, by capillary action) to the transport material. A "transport material" is a material that actively conveys liquid from one end of the material to another, for example by capillary action, such as a wick. The term "barrier" refers to a property that renders the layer impermeable to liquid or prevents transfer of liquid. The term "prevent" is used here with the meaning of at least partially stopping or inhibiting and includes fully stopping or inhibiting. The term "reversible" barrier means that the barrier quality (for example, impermeability to aqueous liquids) may be lost and regained depending on environmental conditions (for example, temperature).

The high retention material may have a fibrous or spongy structure. Preferably, the high retention material includes a web, mat or bundle of fibers. The fibers may be generally aligned to convey the liquid in the aligned direction. Alternatively, the high retention material may include sponge-like or foam-like material. The high retention material may include any suitable material or combination of materials. Examples of suitable materials are a sponge or foam material, ceramic- or graphite-based materials in the form of fibers or sintered powders, a fibrous material, for example made of spun or extruded fibers, or ceramic or glass.

When the cartridge is coupled with the base unit of the aerosol-generating device, at least a portion of the transport material is located sufficiently close to the heating element so that liquid aerosol-forming substrate carried by the transport material may be heated by the heating element to generate an aerosol. The transport material is preferably in contact with the heating element. Alternatively, there may be an intervening layer between the transport material and the fluid permeable heating element, with the intervening layer assisting in providing fluid communication between the transport material and the heating element. In another alternative embodiment where the cartridge does not include transport material, the heating element may heat the barrier layer directly or through the high retention material.

Any suitable heating element may be employed. Preferably the heating element includes a fluid permeable heating element. The fluid permeable heating element may be substantially flat and be made of electrically conductive filaments. The electrically conductive filaments may lie substantially in a single plane. Alternatively, the substantially flat heating element may be curved along one or more dimensions, for example forming a conical shape, a dome shape, an arch shape, or bridge shape.

Alternatively, the fluid permeable heating element may form a hollow tubular or cylindrical shape. The hollow tubular or cylindrical shape may be made of electrically conductive filaments. The hollow tubular or cylindrical shape may be formed by any suitable method, such as for example, rolling up a substantially flat heating element comprising electrically conductive filaments. The electrically conductive filaments may form a side surface of the hollow tubular or cylindrical shape. A transverse cross section of the hollow tubular or cylindrical heater may be circular, oval, or polygonal.

The heating element may be an internal heating element (internal to the cartridge) or an external heating element (part of the aerosol-generating device and external to the cartridge). The heating element may be arranged adjacent the barrier layer, adjacent the transport material, adjacent the high retention material, or adjacent the liquid storage portion, or a combination thereof. If the heating element is an external heating element, the components of the cartridge may be arranged to accommodate the external heating element such that the desired component is adjacent the heating element when the cartridge is installed in the aerosol-generating device.

The heating element may include resistive filaments. The term "filament" refers to an electrical path arranged between two electrical contacts. A filament may have a round, square, flat or any other form of cross-section and may have a diameter of between 10 μm and 100 μm. The filaments may be arranged in a straight or curved manner, and may branch off, diverge, and converge. One or more resistive filaments may form a coil, mesh, array, fabric or the like. Application of an electric current to the heating element results in heating due to the resistive nature of the element. In some preferred embodiments, the heating element forms a mesh, array, or fabric arranged in a substantially flat shape.

The heating element is preferably fluid permeable. This may be achieved by arranging the electrically conductive filaments such that interstices of between 10 μm and 100 μm are formed between the filaments. The filaments may give rise to capillary action in the interstices so that, in use, liquid to be vaporized is drawn into the interstices, increasing the contact area between the heating element and the liquid. The electrically conductive filaments may form a mesh having a mesh size between 160 and 600 mesh US (+/−10%) (i.e. between 63 and 236 filaments (+/−10%) per cm (i.e. between 160 and 600 filaments (+/−10%) per inch)). The area of the fluid permeable heating element may be small, for example less than or equal to 50 $mm^2$.

The mesh may be formed using different types of weave or lattice structures or an array of parallel filaments. The filaments may be individually formed and woven together to form the mesh, or the filaments may be formed by etching a sheet material, such as a foil.

The filaments of the heating element may be formed from any material with suitable electrical properties. Suitable materials include but are not limited to: semiconductors such as doped ceramics, electrically conductive ceramics (such as, for example, molybdenum disilicide), carbon, graphite, metals, metal alloys, composite materials made of a ceramic material and a metallic material, and combinations thereof. Preferably, the filaments are made of wire. More preferably, the wire is made of metal, most preferably made of stainless steel.

The systems of the present disclosure include a cartridge with high retention material to retain liquid aerosol-forming substrate. In some examples, the high retention material is arranged to convey the liquid aerosol-forming substrate to a transport material during use. In some examples the cartridge does not include transport material, and the high retention material is arranged to convey the liquid aerosol-forming substrate directly to the heating element or to an airflow passage.

The high retention material may include a capillary material having a fibrous or porous structure which forms a plurality of small bores or micro-channels. Liquid aerosol-forming substrate may be transported through the capillary material by capillary action. The high retention material may include a plurality of fibers, threads, or other fine bore tubes that form a bundle of capillaries. The fibers or threads may be generally aligned to convey liquid aerosol-forming substrate towards the transport material. Alternatively, the retention material may include sponge-like or foam-like material. The retention material may include any suitable material or combination of materials. Examples of suitable materials include a sponge or foam material, ceramic- or graphite-based materials in the form of fibers or sintered powders, foamed metal or plastic materials, fibrous materials (for example, spun or extruded fibers, such as cellulose acetate, polyester, bonded polyolefin, polyethylene, polypropylene fibers, nylon fibers, ceramic fibers), and combinations thereof. In one exemplary embodiment, the retention material includes high density polyethylene (HDPE) or polyethylene terephthalate (PET). The high retention material may have a superior wicking performance compared to the transport material such that it retains more liquid per unit volume than the transport material. The transport material may have a higher thermal decomposition temperature than the high retention material.

The cartridge may also include transport material arranged to deliver the aerosol-forming substrate to the heating element. The transport material may be in the shape of a disc. Such discs may be conveniently manufactured by punching out of a sheet of material. However, any other suitable shape may be used, such as a square, rectangle, oval, ovoid, or another curved or polygonal shape or an irregular shape. The thickness of the transport material may be less than the length or width or diameter of the transport material. Any suitable aspect ratio of the length or width or diameter to the thickness may be used. The aspect ratio of the length or width or diameter of the transport material to the thickness of the transport material may be greater than 3:1.

Alternatively, the transport material may be in the shape of a hollow tube or cylinder in accordance with a hollow tubular or cylindrical heating element. The hollow tubular or cylindrical transport material may be formed by any suitable method, such as for example, rolling up a sheet of material. The inner diameter of the tube or cylinder of transport material may be more than the outer diameter of the hollow tubular or cylindrical heater.

The transport material may have a first surface facing the high retention material and an opposing second surface facing the heating element. In a preferred embodiment, the second surface of the transport material is in contact with the heater. If the heater has a planar surface, the second surface may be planar and may be in contact with the planar surface of the heater. If the heater has a contoured surface, the second surface may have a contour that follows the contoured surface of the heater and is in contact with the contoured surface of the heater. For example, if the heater has a convex dome-shaped surface, the second surface of the transport material may follow the dome shape. This shape may be added to the transport material or may be a by-product of manufacturing the transport material. The first surface and the second surface correspond to an outer surface and an inner surface of the hollow cylindrical transport material, respectively. The heating element, whether in a cartridge containing the transport material or in a device configured to receive a capsule containing the transport material, may also have a residual bowed shape as a result of some manufacturing processes and therefore the surface of the transport material may conform to the shape of the heating element.

The transport material may also include a capillary material. A capillary material is a material that conveys liquid through the material by capillary action. The transport material may have a fibrous or porous structure. The transport material preferably comprises a bundle of capillaries. For example, the transport material may comprise a plurality of fibers or threads or other fine bore tubes. The transport material may be configured to primarily transport liquid in a direction orthogonal or normal to the thickness direction of the transport material. The transport material may preferably comprise elongate fibers such that capillary action occurs in the small spaces or micro-channels between the fibers.

The transport material may be made of a heat resistant material having a thermal decomposition temperature of at least 160° C. or higher, such as approximately 250° C. or higher. The transport material may comprise fibers or threads of cotton or treated cotton, such as acetylated cotton. Other suitable materials could also be used, such as, for example, ceramic- or graphite based fibrous materials or materials made from spun, drawn, or extruded fibers, such as fiberglass, cellulose acetate, or any suitable heat resistant polymer. The fibers of the transport material may each have a thickness of between 10 μm and 40 μm and more particularly between 15 μm and 30 μm. The transport material may have any suitable capillarity and porosity so as to be used with liquid having different physical properties. The transport material may transport the liquid aerosol-forming substrate by capillary action. The liquid aerosol-forming substrate may have physical properties including viscosity, surface tension, density, thermal conductivity, boiling point, vapor pressure, and the like, that are tailored to facilitate transport of the liquid aerosol-forming substrate through the transport material by capillary action.

According to aspects of the present disclosure, the cartridge includes a barrier layer in the liquid flow channel. According to aspects of the present disclosure, the cartridge includes a barrier layer between the liquid aerosol-forming substrate and the airflow passage.

The term "layer" is used here to refer to a barrier that is a distinct layer, a film, or a coating, which may be applied to either the high retention material, to the transport material, or to both, or may be stacked between the two materials.

The barrier layer may be impermeable or substantially impermeable to aqueous liquids below a threshold temperature and becomes reversibly permeable to liquids at or above the threshold temperature. In some embodiments, the barrier layer is hydrophobic below the threshold temperature. The barrier layer may become reversibly permeable to liquid (for example, become hydrophilic or create pores) in a temperature-dependent manner. For example, the material of the barrier layer may be selected such that the barrier layer becomes permeable to liquids (for example, to aqueous liquids) at or above a pre-determined threshold temperature. The barrier layer may be impermeable below the threshold temperature and permeable above the threshold temperature. In some embodiments, the barrier layer includes gates or pores that are closed below the threshold temperature and open above the threshold temperature. According to an embodiment, the barrier layer may be rendered permeable at or above the threshold temperature and may be again rendered impermeable if the temperature of the layer is lowered below the threshold temperature.

Permeability of the barrier layer can be determined by evaluating the permeation of a liquid aerosol-forming substrate (for example, e-liquid) through the barrier. Two milliliters of liquid aerosol-forming substrate (based on different ratios of VG/PG and on pure PG and on pure VG) is placed on the top surface of the membrane under ambient temperature (0° C. to 50° C.) and relative humidity between 25% and 90%. The amount of liquid remaining on the top surface is monitored. If the decreasing rate of the amount of liquid on the top surface of the membrane is within 1 wt % for 1 week, the membrane will be considered impermeable.

The pre-determined threshold temperature may be selected to be such that when the heating element begins to heat the transport material and the barrier layer upon activation of the system, the barrier layer becomes permeable, allowing liquid to pass from the high retention material or the liquid storage portion. For example, in some embodiments the heating element heats to a temperature of about 200° C., and heat is conducted into the barrier layer (for example, by being conducted into the transport material and through the transport material). The heating element may heat the transport material to a temperature of about 200° C., or to a temperature of at least 150° C., at least 175° C., or at least 200° C. The heating element may heat the transport material to a temperature of up to 175° C., up to 200° C., up to 210° C., up to 220° C., or up to 240° C. The heating element may heat the barrier layer (either directly or indirectly) to or above a pre-determined threshold temperature. The pre-determined threshold temperature may be 60° C. or higher, 70° C. or higher, 80° C. or higher, 90° C. or higher, or 100° C. or higher. The pre-determined threshold temperature may be 200° C. or lower, 180° C. or lower, 150° C. or lower, 130° C. or lower, 120° C. or lower, 105° C. or lower, or 100° C. or lower. The pre-determined threshold temperature may be affected by the selection of the material, construction, size, and other qualities of the barrier layer.

Preferably the barrier layer is made from non-toxic materials, produces non-toxic degradation products, or is made from non-toxic materials and produces non-toxic degradation products. Materials that are approved for medical applications or for food packaging are preferred. For example, materials that are approved by the Federal Drug Administration ("FDA") in the United States for use in medical applications (for example, in drug delivery, sutures, adhesion barriers, etc.), for food packaging, or for medical applications and food packaging are considered suitable for use in the barrier layer.

The material of the barrier layer may be selected to have the desired reversible barrier quality. For example, the barrier layer may include materials that forms gates either during or after the formation of the barrier layer. The gates may be opened and closed in a temperature-dependent manner by various mechanisms, including swelling, shrinking, collapsing of chains, etc. For example, the gates may be formed by temperature reactive material that includes a covalently cross-linked reversible polymer (for example, a cross-linked hydrogel) that exhibits swelling below the threshold temperature and shrinking above the threshold temperature. The pores or gates in the barrier layer may have a size (for example, diameter) of about 0.01 μm to about 0.1 μm, or at least 0.01 μm, at least 0.02 μm, or at least 0.05 μm, or up to 0.2 μm, up to 0.5 μm, or up to 1 μm.

One group of suitable materials for the barrier layer include covalently cross-linked reversible polymers that exhibit changes in polymer-polymer or solvent-polymer (for example, water-polymer) interactions due to changes in temperature. The gates in such materials may be fabricated by blending functional grafted polymers or block copolymers or microspheres with the membrane-forming material. Polymer systems that exhibit an inverse U-shaped phase transfer curve and an upper critical solution temperature ("UCST") in a suitable range for a threshold temperature are considered suitable for use in a barrier layer. The UCST and therefore the threshold temperature may be adjusted by the selection or number of functional groups (e.g., amino groups) and/or the chemical structure of the polymeric chains. Examples of suitable polymer systems include poly (allylurea-co-allylamine) (PAU-Am) with amino-groups (for example, PAU and azidophenyl-PAU or "AP-PAU"), and poly(pentafluorophenyl acrylate). The threshold temperatures of these reversible polymers may be in the range of 40° C. or greater, 50° C. or greater, or 60° C. or greater; or 100° C. or lower, 90° C. or lower, 80° C. or lower, 70° C. or lower, or 65° C. or lower.

Another group of suitable gate-forming materials for the barrier layer include adsorbed or surface-grafted chains. The surface-grafted chains may be hydrophilic or hydrophobic depending on temperature. In such barrier layers, gates are formed on the barrier layer membrane by grafting functional monomers ("grafting from") or functional polymers or microspheres ("grafting to") onto the active sites on the membrane so that the grafted moieties constitute linear polymers or cross-linked polymers in the pores. Monomers may be grafted by chemical, radiation, radical, UV-induced, or plasma-induced grafting. Polymers and/or microspheres may be chemically bonded (for example, covalently bonded) to the layer. Suitable membrane forming materials for the barrier layer include polypropylene (PP), polyethylene terephthalate (PET), poly(ethersulfone) (PES), hollow-fiber membranes, and polystyrene-b-poly(4-vinylpyridine) (PS-b-P4VP) diblock copolymer membranes. Suitable adsorbed or surface-grafted chain materials (for example, gate-forming materials) include Poly(N-isopropylacrylamide) (PNIPAAm; threshold temperature in the range of 30-35° C.); poly(2-ethyl-2-oxazoline) (PEOx; threshold temperature of about 60° C.); poly(2-ethyl-2-oxazine) (PEOZI; threshold temperature of about 56° C.); PEO-b-PPO block copolymers (threshold temperature of about 80° C.); and natural thermo-responsive polymers (approved by FDA for biomedical applications), such as hydroxypropylmethyl cellulose (HPMC; threshold temperature of about 69° C.). The threshold temperatures of barrier layers prepared with the above membrane-forming and gate-forming material may be in the range of 40° C. or greater, 50° C. or greater, or 60° C. or greater; or 100° C. or lower, 90° C. or lower, 80° C. or lower, 70° C. or lower, or 65° C. or lower. The threshold temperature may be modified by changing the amount and type of hydrophilic monomers (for example, by reducing the amount to increase threshold temperature). For example, when NIPAAm (N-isopropylacrylamide) is copolymerized with hydrophilic monomers such as acrylamide, the threshold temperature increases to about 45° C. when 18 of acrylamide is incorporated to the polymer, whereas threshold temperature decreases to about 10° C. when 40% of hydrophobic N-tert butylacrylamide (N-tBAAm) is added to the polymer.

In one embodiment, the barrier is made from a modified membrane, where the membrane includes polypropylene (PP), polyethylene terephthalate (PET), poly(ethersulfone) (PES), hollow-fiber membranes, and polystyrene-b-poly(4-vinylpyridine) (PS-b-P4VP) diblock copolymer membranes. In one embodiment, the membrane is modified with a temperature reactive material. The temperature reactive material may include linear polymer chains, cross-linked hydrogel networks, microspheres, or a combination thereof. The temperature reactive material may include a covalently cross-linked reversible polymer comprising poly(allylurea-co-allylamine) (PAU-Am), poly(pentafluorophenyl acrylate), or a combination thereof. The temperature reactive material may include poly(N-isopropylacrylamide) (PNIPAAm), poly(2-ethyl-2-oxazoline) (PEOx), poly(2-ethyl-2-oxazine) (PEOZI), PEO-b-PPO block copolymers, hydroxypropylmethyl cellulose (HPMC), or a combination thereof.

Combinations of materials may be used to tailor the threshold temperature to be suitable for a given device.

Other aspects of the barrier layer material that may be varied to achieve a desired threshold temperature include monomer structure and selection, molecular weight, crystallinity of the polymer, thickness of the barrier layer, etc. These same qualities may also be used to adjust the permeability change rate of the barrier layer. For example, it may be desirable that upon reaching the threshold temperature, the barrier layer becomes permeable in less than 2 s, less than 1 s, or less than 0.5 s. It may be desirable that the barrier layer becomes permeable as fast as possible upon reaching the threshold temperature and that there is no desired minimum time. However, in practice, the barrier layer may become permeable in 10 ms or greater, in 50 ms or greater, or in 100 ms or greater. In some embodiments, the barrier layer becomes permeable in at least 10 ms, at least 50 ms, or at least 100 ms, and in up to 0.5 s, up to 1 s, up to 2 s, or up to 4 s.

The barrier layer may have a thickness of about 10 μm or greater, about 20 μm or greater, about 50 μm or greater, or about 100 μm or greater. The barrier layer may have a thickness of about 1000 μm or less, about 800 μm or less, about 500 μm or less, or about 300 μm or less.

In some preferred embodiments, the cartridge containing liquid aerosol-forming substrate in a high retention material, a transport material, and a barrier layer separating the high retention material and the transport material has a shelf life of 4 months or greater; 5 months or greater; 6 months or greater; 7 months or greater; or 8 months or greater. The cartridge may have a shelf life of up to 24 months, up to 18 months, or up to 12 months. The term "shelf life" is used here to refer to a period of time during which the product (for example, the liquid aerosol-forming substrate and/or the barrier layer) does not significantly degrade, become unusable, or become unacceptable to a consumer (for example, does not leak).

The cartridge of the present disclosure may be pre-loaded into an aerosol-generating device or may be inserted into the device by a user. When the cartridge is disposed in the aerosol-generating device, the transport material is operably coupled with the heating element such that the transport material may be heated by the heating element. Heating of the transport material also heats the barrier layer and renders the barrier layer permeable to liquids (for example, aqueous liquid). In embodiments where the cartridge does not include a transport material, the heating element may heat the barrier layer directly. Once the barrier layer becomes permeable to liquids, the liquid aerosol-forming substrate from the high retention material may be delivered (for example, by capillary action) into the transport material and be heated by the heating element. Cooling of the barrier layer may render the barrier layer again impermeable to liquids e.g., aqueous liquid).

One or more air inlet may be formed in the housing of the cartridge or a base unit to allow air to be drawn into the cartridge to entrain aerosol resulting from the heating of the aerosol-forming substrate. The aerosol containing stream may then be guided through a passage in the cartridge or cartridge to the mouth end of the device.

The base unit includes a housing and the power supply disposed in the housing. The base unit may also include electronic circuitry disposed in the housing and electrically coupled to the power supply. The base unit may include contacts exterior to, exposed through, or effectively formed by the housing such that the contacts of the part electrically couple with the contacts of the cartridge when the base unit is connected with the cartridge. The contacts of the part are electrically coupled to the electronic circuitry and power supply. Thus, when the part is connected to the cartridge, the heating element is electrically coupled to the power supply and circuitry.

Preferably, the electronic circuitry is configured to control delivery of an aerosol resulting from heating of the substrate to a user. Control electronic circuitry can be provided in any suitable form and may, for example, include a controller or a memory and a controller. The controller can include one or more of an Application Specific Integrated Circuit (ASIC) state machine, a digital signal processor, a gate array, a microprocessor, or equivalent discrete or integrated logic circuitry. Control electronic circuitry can include memory that contains instructions that cause one or more components of the circuitry to carry out a function or aspect of the control circuitry. Functions attributable to control circuitry in this disclosure can be embodied as one or more of software, firmware, and hardware.

The electronic circuitry may be configured to monitor the electrical resistance of the heater element or of one or more filaments of the heating element, and to control the supply of power to the heating element dependent on the electrical resistance of the heating element or the one or more filaments. The electronic circuitry may include a microprocessor, which may be a programmable microprocessor. The electronic circuitry may be configured to regulate a supply of power. The power may be supplied to the heater assembly in the form of pulses of electrical current.

The part that includes the power supply may include a switch to activate the system. For example, the part may include a button that can be depressed to activate or optionally deactivate the system. Alternatively, the system may include a sensor constructed to activate the system when the sensor senses an airflow caused by the user suctioning air through the mouthpiece.

The power supply is typically a battery but may include another form of charge storage device such as a capacitor. The power supply may be rechargeable.

The housing of the base unit is preferably a rigid housing. Any suitable material or combination of materials may be used for forming the rigid housing. Examples of suitable materials include metals, alloys, plastics or composite materials containing one or more of those materials, or thermoplastics that are suitable for food or pharmaceutical applications, for example polypropylene, polyetheretherketone (PEEK), acrylonitrile butadiene styrene and polyethylene.

An aerosol-generating system of the present invention may include a cover that is disposable over at least the liquid supply system. For example, the cover includes a distal end opening that is configured to receive the cartridge. The cover may also extend over at least a portion of the vaporizing unit if the system includes a separate vaporizing unit, and may also extend over at least a portion of the base unit. The cover may be releasably securable in a position relative to at least the cartridge. The cover may be connected to the cartridge or base unit in any suitable manner, such as threaded engagement, snap-fit engagement, interference-fit engagement, magnetic engagement, or the like.

The cover or the housing of the cartridge may form a mouthpiece that defines the mouth end of the aerosol-generating system. Preferably, the mouthpiece is generally cylindrical and may taper inwardly towards the mouth end. The mouthpiece defines a mouth end opening to allow aerosol resulting from heating of the aerosol-forming substrate to exit the device.

The terms "distal," "upstream," "proximal," and "downstream" are used to describe the relative positions of components, or portions of components, of an aerosol-generating system. Aerosol-generating systems according to the invention have a proximal end and an opposing distal end, where, in use, an aerosol exits the proximal end of the system for delivery to a user. The proximal end of the aerosol-generating article may also be referred to as the mouth end. In use, a user draws on the proximal end of the aerosol-generating system in order to inhale an aerosol generated by the aerosol-generating system. The terms upstream and downstream are relative to the direction of aerosol movement through the aerosol-generating system when a user draws on the proximal end. The cover or housing and the cartridge cooperate to form one or more channels between them through which air may flow.

The cover includes an elongate housing, which is preferably rigid. The housing may include any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene.

An aerosol-generating system according to the present invention, when all parts are connected, may have any suitable size. For example the system may have a length from about 50 mm to about 200 mm. Preferably, the system has a length from about 100 mm to about 190 mm. More preferably, the system has a length from about 140 mm to about 170 mm.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed to mean one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The term "substantially" as used here has the same meaning as "significantly," and can be understood to modify the term that follows by at least about 90%, at least about 95%, or at least about 98%. The term "not substantially" as used here has the same meaning as "not significantly," and can be understood to have the inverse meaning of "substantially," i.e., modifying the term that follows by not more than 10%, not more than 5%, or not more than 2%.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components.

The schematic drawings are not necessarily to scale and are presented for purposes of illustration and not limitation.

Figure 1:
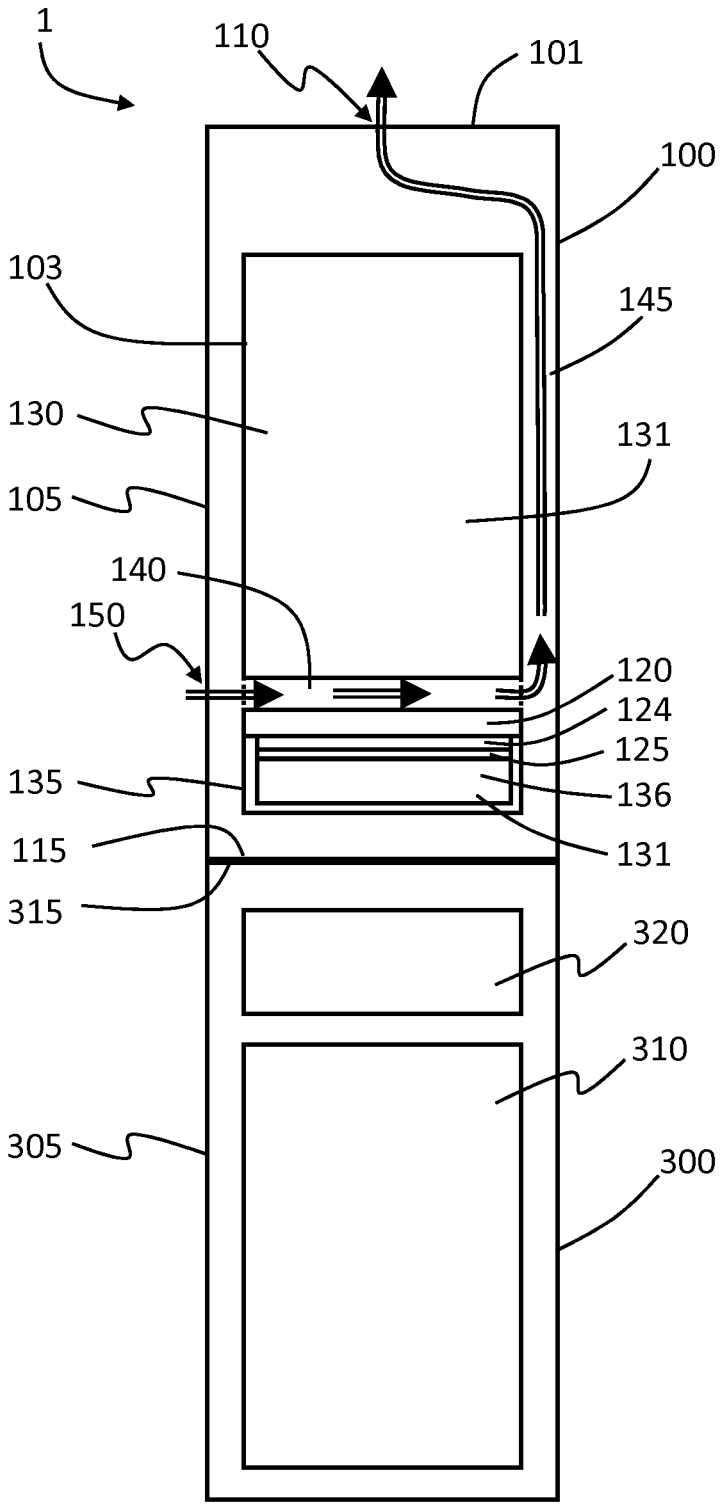
FIG. 1 is a schematic drawing of an example of an aerosol-generating system.

Referring now to FIG. 1, an aerosol-generating system 1 includes two main components, a cartridge 100 and a base unit 300. The cartridge 100 extends from a mouth end 101 to a connection end 115. The cartridge 100 is removably connected to a corresponding connection end 315 of the base unit 300. The base unit 300 contains a housing 305 in which a battery 310, control circuitry 320, and any associated electronic circuitry (for example, electrical conductors and contacts extending through the housing) are disposed. The aerosol-generating system 1 may be portable and may have a size comparable to a conventional smoking article, such as a cigar or cigarette.

The cartridge 100 includes a housing 105 containing a heater assembly 120 and a liquid storage compartment 103 having a first portion 130 connected to a second portion 135. A liquid aerosol-forming substrate 131 is held in the liquid storage compartment. The first portion 130 of the liquid storage compartment 103 is in fluid communication with the second portion 135 of the liquid storage compartment 103 so that liquid in the first portion 130 can pass to the second portion 135 (see FIG. 2). The second portion 135 includes high retention material 136, a barrier layer 125, and transport material 124. The heater assembly 120 contacts the second portion 135 via the transport material 124. In the embodiment shown, the heater assembly 120 is a fluid permeable heating element.

An airflow passage 140, 145 extends through the cartridge 100 from an air inlet 150 formed on a side of the housing 105, past the heater assembly 120, and from the heater assembly 120 to a mouthpiece opening 110 formed at the mouth end 101 of the housing 105. A mouthpiece is arranged at the mouth end 101 of the cartridge 100 opposite the connection end 115.

In the exemplary embodiment shown, the components of the cartridge 100 are arranged such that the first portion 130 of the liquid storage compartment 103 is disposed between the heater assembly 120 and the mouth end 101, and the second portion 135 of the liquid storage compartment 103 is positioned on an opposite side of the heater assembly 120, adjacent the connection end 115. In other words, the heater assembly 120 is disposed between the two portions 130, 135 of the liquid storage compartment 103 and is arranged to receive liquid from the second portion 135 after the barrier layer 125 becomes permeable. The airflow passage 140, 145 extends past the heater assembly 120 and between the first portion 130 and second portion 135 of the liquid storage compartment 103.

The system is configured so that a user can puff or draw on the mouthpiece opening 110 of the cartridge to draw aerosol from the device. When the system 1 is activated, the control circuitry 320 controls the supply of electrical power from the battery 310 to the cartridge 100. The control circuitry 320 may include an airflow sensor (not shown) may supply electrical power to the heater assembly 120 when a user puffs on the cartridge 100, as detected by the airflow sensor. Alternatively, the system 1 may be activated by pushing on a button. When the system 1 is activated, the heater assembly 120 is activated, thus heating the transport material 124 and the barrier layer 125. Once the barrier layer 125 reaches its pre-determined threshold temperature, the barrier layer 125 becomes permeable to liquid (for example, gates in the barrier layer are opened), allowing the liquid aerosol-forming substrate 131 from the high retention material 136 to be passed onto the transport material 124. The heater assembly 120 heats the liquid aerosol-forming substrate 131 and generates a vapor that is entrained in the airflow passing through the airflow passage 140. The vapor cools within the airflow in passage 145 to form an aerosol, which is then drawn into the user's mouth through the mouthpiece opening 110.

Figure 2:
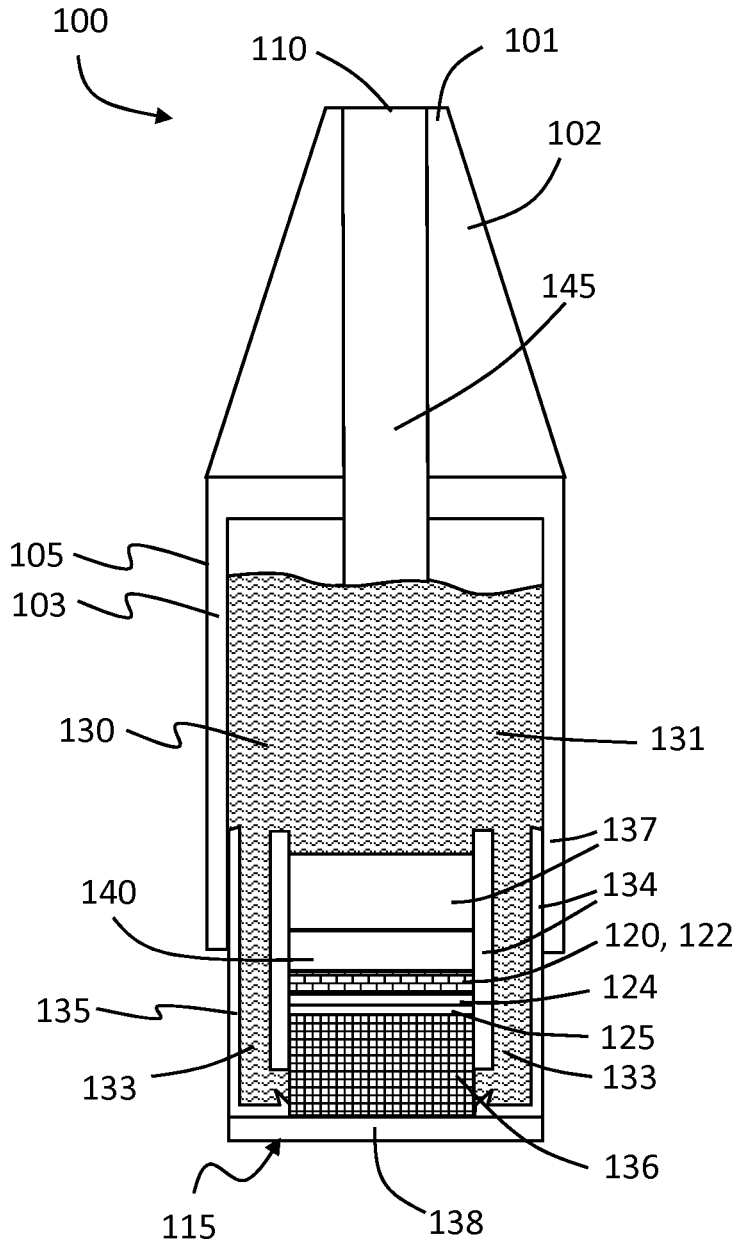
FIG. 2 is a schematic drawing of a liquid supply system according to an embodiment.

FIG. 2 is a schematic cross section of an exemplary cartridge 100 according to an embodiment. The cartridge 100 has an external housing 105 extending from the mouth end 101 to a connection end 115 opposite the mouth end 101. The external housing 105 includes a mouthpiece 102 defining a mouthpiece opening 110. A liquid storage compartment 103 holding a liquid aerosol-forming substrate 131 is disposed within the housing 105. The liquid storage compartment 103 has a first portion 130 and a second portion 135. The liquid storage compartment 103 may further be defined by an upper storage compartment housing 137, a heater mount 134, and an end cap 138. A heater assembly 120 including a fluid permeable heating element 122 is held in the heater mount 134. A retention material 136 and a transport material 124, separated by a barrier layer 125, are provided in the second portion 135 of the liquid storage compartment 103 such that the transport material 124 abuts the heater assembly 120. The retention material 136 is arranged to convey liquid to the transport material 124 upon heating of the barrier layer 125 to its threshold temperature.

Liquid in the first portion 130 of the liquid storage compartment 103 can travel to the second portion 135 of the liquid storage compartment 103 through liquid channels 133 on either side of the heater assembly 120. Two channels are shown in this example to provide a symmetric structure, although only one channel is necessary. The channels 133 are enclosed liquid flow paths defined between the upper storage compartment housing 137 and the heater mount 134.

The fluid permeable heating element 122 is generally planar and is arranged adjacent the transport material 124, between the transport material 124 and the airflow passage 140. A first surface of the transport material 124 faces the barrier layer 125, and a second surface opposite of the first surface is in contact with the fluid permeable heating element 122. The first surface of the transport material 124 may come into fluid communication with the high retention material 136 once the barrier layer 125 reaches its threshold temperature and becomes permeable to liquid (for example, gates in the barrier layer are opened).

The fluid permeable heating element 122 may form a bottom wall of the airflow passage 140. The heater mount 134 and the surface of the upper storage compartment housing 137 may form the side and top walls of the airflow passage 140, respectively. A vertical portion of the airflow passage 145 extends through the first portion 130 of the liquid storage compartment towards the mouthpiece opening 110.

The arrangement of FIG. 2 is only one, non-limiting, example of a cartridge for an aerosol-generating system. Other arrangements are possible. For example, the fluid permeable heating element, transport material and retention material could be arranged in a different order without deviating from the aspects of the present invention.

Figure 3:
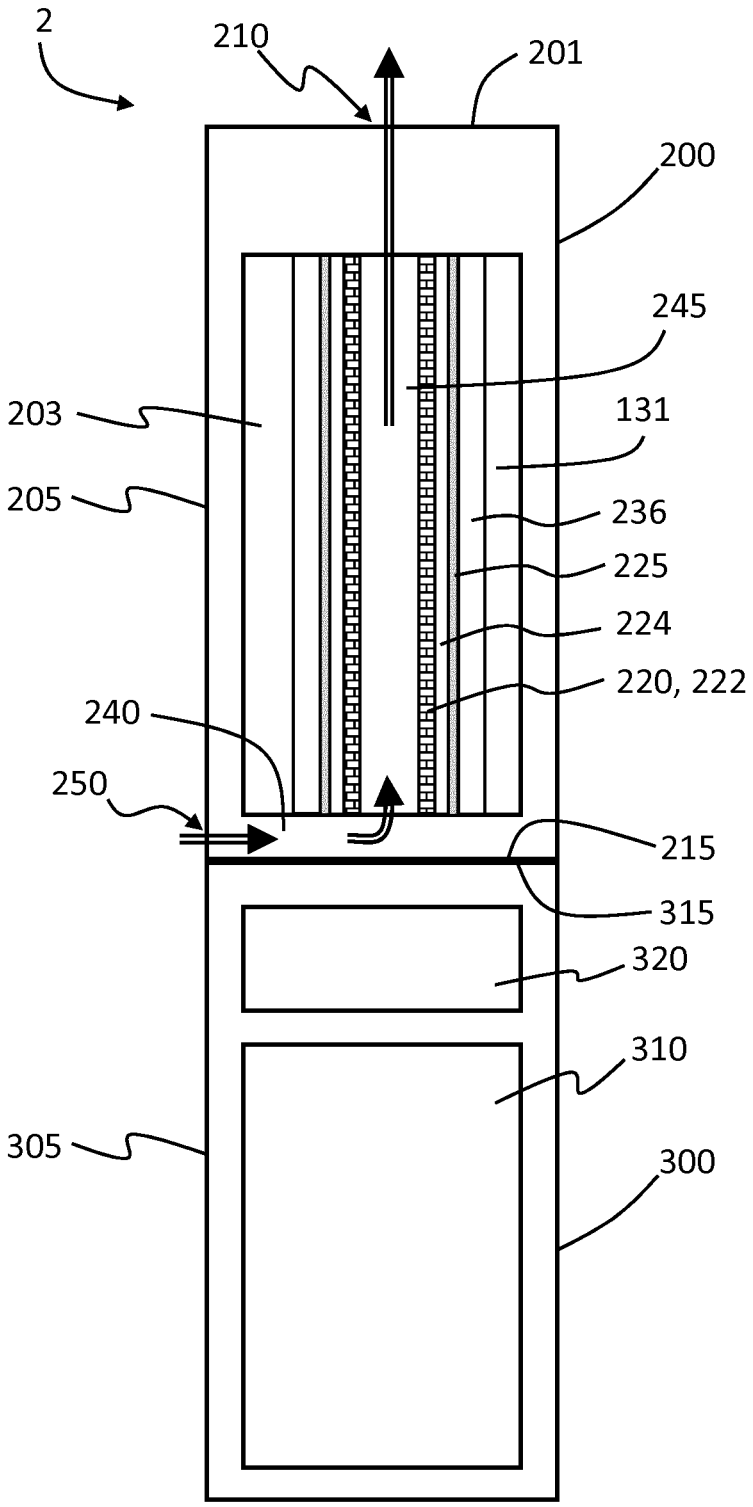
FIG. 3 is a schematic drawing of another example of an aerosol-generating system.

FIG. 3 shows an alternative arrangement of an aerosol-generating system 2 that includes a tubular or cylindrical a heater assembly 220 and liquid storage compartment 203. Similar to the system shown in FIG. 1, the aerosol-generating system 2 includes two main components, a cartridge 200 and a base unit 300. The cartridge 200 extends from a mouth end 201 to a connection end 215. The cartridge 200 is removably connected to a corresponding connection end 315 of the base unit 300. The base unit 300 is as shown in FIG. 1. The aerosol-generating system 2 may be portable and may have a size comparable to a conventional smoking article, such as a cigar or cigarette.

The cartridge 200 includes a housing 205 containing a heater assembly 220 and a liquid storage compartment 203. The heater assembly 220 includes a fluid permeable heating element 222. In the example shown in FIG. 3, the heating element 222 and liquid storage compartment 203 are cylindrical and coaxial such that the liquid storage compartment 203 at least partially surrounds the heating element 222. A liquid aerosol-forming substrate 131 is held in the liquid storage compartment 203.

The cartridge 200 further includes high retention material 236, a barrier layer 225, and transport material 224. In example shown, the high retention material 236 is arranged adjacent the liquid storage compartment 203 and the barrier layer 225 is arranged adjacent the high retention material 236 is and between the high retention material 236 and the transport material 224. Each of the elements shown may be cylindrical or tubular. Each of the elements may be coaxial with one another.

The heating element 222 is arranged to receive liquid from the liquid storage compartment 203 and the high retention material 236 via the transport material 224 once the barrier layer 225 is made permeable.

The cartridge may alternatively be prepared without a liquid storage compartment 203, in which case the liquid aerosol-forming substrate 131 may be stored in the high retention material 236. In embodiments that do not include a liquid storage compartment 203, the amount of liquid aerosol-forming substrate 131 and therefore also the number of puffs available from the device may be less than from devices that include a liquid storage compartment 203.

The cartridge may also alternatively be prepared without a transport material 224, in which case the barrier layer 225 may be arranged adjacent or immediately adjacent (for example, in contact with) the heating element 222.

In some embodiments, the cartridge is prepared without the liquid storage compartment 203 and the transport material 224.

The heating element 222 forms a cavity at its center to facilitate airflow. An airflow passage 240, 245 extends through the cartridge 200 from an air inlet 250 formed on a side of the housing 205, through the center cavity of the heating element 222 and to a mouthpiece opening 210 formed at the mouth end 201 of the housing 205. A mouthpiece may be arranged at the mouth end 201 of the cartridge 200 opposite the connection end 215.

The system 2 is configured to be used in a similar manner as explained for the system 1 of FIGS. 1 and 2.

Figure 4:
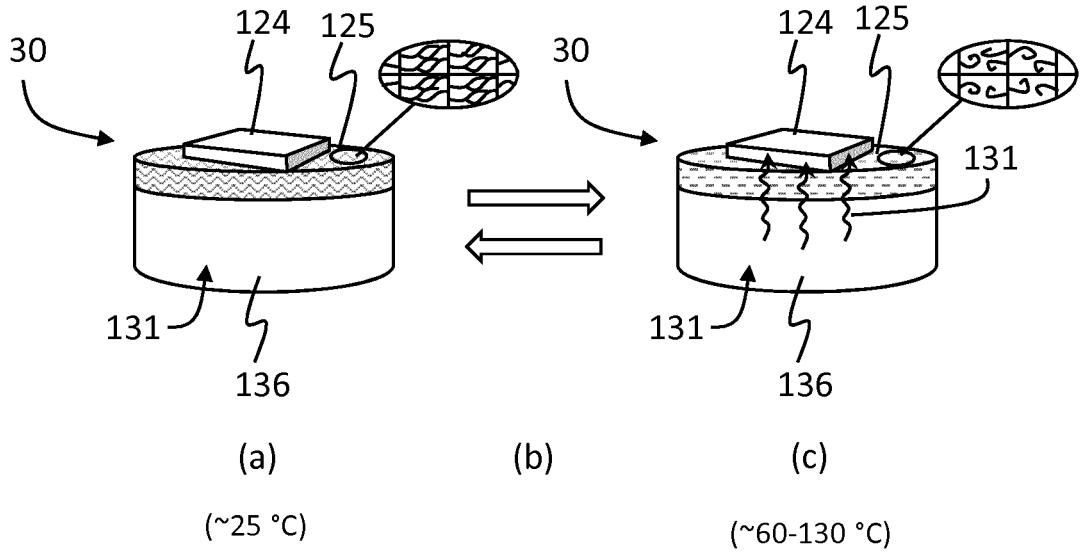
FIG. 4 is a schematic drawing of a part of the liquid supply system according to an embodiment.

FIG. 4 is a schematic depiction of a liquid storage unit 30 according to aspects of the present disclosure. The liquid storage unit 30 may be housed, for example, inside a cartridge 100, 200 that may be coupled with a base unit 300 of an aerosol-generating system 1, 2, such as those shown in FIGS. 1 and 3.

As shown in FIG. 4, the liquid supply system 30 includes high retention material 136 containing liquid aerosol-forming substrate 131, and a transport material 124 arranged to come into contact with the heater assembly 120 of the aerosol-generating system 1. The high retention material 136 is capped at least on one side by a barrier layer 125 that, below a threshold temperature, is impermeable to the liquid aerosol-forming substrate 131 and that prevents the liquid aerosol-forming substrate 131 from reaching the transport material 124 (step a). However, when heat is applied to the barrier layer 125 (step b), bringing its temperature to a pre-determined threshold temperature (for example, to a temperature of 60° C. or higher), the structure of the barrier layer 125 changes, causing gates in the layer to open and allowing liquid to pass from the high retention material 136 to the transport material 124 (step c).

Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol-generating article manufacturing or related fields are intended to be within the scope of the following claims.

The invention claimed is:

1. A liquid supply system for use with an aerosol-generating device, the liquid supply system comprising:

a liquid retention material;

a liquid flow channel extending from the liquid retention material; and a barrier disposed in the liquid flow channel, the barrier having a threshold temperature between 60° C. and 120° C., wherein the barrier is impermeable to liquid below its threshold temperature and the barrier becomes reversibly permeable to liquid above the threshold temperature, wherein the barrier comprises a polymer layer and a temperature reactive material dispersed therein, and wherein the temperature reactive material forms pores in the polymer layer above the threshold temperature.

2. A liquid supply system according to claim 1, wherein the barrier comprises material with a threshold temperature between 70° C. and 120° C.

3. A liquid supply system according to claim 1, the liquid supply system further comprising: a liquid transport material disposed on a downstream side of the liquid retention material.

4. A liquid supply system according to claim 3, wherein the barrier is disposed on a downstream side of the liquid transport material, or between the liquid transport material and the liquid retention material.

5. A liquid supply system according to any claim 1, wherein the liquid supply system further comprises: a liquid storage disposed on an upstream side of the liquid retention material.

6. A liquid supply system according to claim 5, wherein the barrier is disposed between the liquid retention material and the liquid storage.

7. A liquid supply system according to claim 1, wherein the barrier comprises a deposited film, a coating, or a stacked layer disposed on the liquid retention material, on the liquid transport material, or both.

8. A liquid supply system according to claim 1, wherein the temperature reactive material comprises linear polymer chains, cross-linked hydrogel networks, microspheres, or a combination thereof.

9. A liquid supply system according to claim 1, wherein the temperature reactive material comprises a covalently cross-linked reversible polymer comprising poly(allylurea-co-allylamine) (PAU-Am), poly(pentafluorophenyl acrylate), or a combination thereof.

10. A liquid supply system according to claim 8, wherein the temperature reactive material comprises poly(N-isopropylacrylamide) (PNIPAAm), poly(2-ethyl-2-oxazoline) (PEOx), poly(2-ethyl-2-oxazine) (PEOZI), PEO-b-PPO block copolymers, hydroxypropylmethyl cellulose (HPMC), or a combination thereof.

11. A cartridge for use with an aerosol-generating device, the cartridge comprising:

a housing;

a liquid supply system according claim 1, disposed in the housing; and a volume of liquid aerosol-forming substrate contained in the liquid retention material.

12. An aerosol-generating system comprising:

a cartridge comprising a liquid supply system according to claim 1 disposed in the cartridge, and a liquid disposed within the liquid supply system; and an aerosol-generating device configured to receive the cartridge; to heat the barrier to a temperature above the threshold temperature; and to heat at least a portion of liquid supplied from the liquid retention material.

13. An aerosol-generating system comprising:

a cartridge comprising a liquid supply system according to claim 3 disposed in the cartridge, and a liquid disposed within the liquid supply system; and an aerosol-generating device configured to receive the cartridge; to heat the barrier to a temperature above the threshold temperature; and to heat the liquid transport material to a temperature of about 200° C. or greater to aerosolize at least a portion of the liquid once the liquid has transferred to the liquid transport material.

14. An aerosol-generating system comprising:

a cartridge comprising a liquid supply system according to claim 4 disposed in the cartridge, and a liquid disposed within the liquid supply system; and an aerosol-generating device configured to receive the cartridge; to heat the barrier to a temperature above the threshold temperature; and to heat the liquid transport material to a temperature of about 200° C. or greater to aerosolize at least a portion of the liquid once the liquid has transferred to the liquid transport material.

* * * * *